United States Patent [19]

Kumar

[11] Patent Number: 4,933,624

[45] Date of Patent: Jun. 12, 1990

[54] ELECTRIC POWER SUPPLY WITH CONTROLLABLE VOLTAGE BOOST

[75] Inventor: Ajith K. Kumar, Erie, Pa.

[73] Assignee: General Electric Company, Erie, Pa.

[21] Appl. No.: 303,196

[22] Filed: Jan. 30, 1989

[51] Int. Cl.[5] ..... G05F 1/62

[52] U.S. Cl. ..... 323/259; 323/255; 323/340; 323/344

[58] Field of Search ..... 363/84, 85, 86, 87, 363/88, 89, 101, 126, 128; 323/235, 247, 255, 257, 258, 259, 301, 319, 320, 328, 340, 344; 307/18, 20, 22, 24, 80, 85, 86, 241

[56] References Cited

U.S. PATENT DOCUMENTS

| | | | |
|---|---|---|---|
| 2,834,931 | 5/1958 | Walker | 363/101 |
| 3,128,440 | 4/1964 | Davis | 323/344 |
| 3,263,157 | 7/1966 | Klein . | |
| 3,270,270 | 8/1966 | Yenisey | 363/86 |
| 3,331,008 | 7/1967 | Bedford | 363/101 X |
| 3,470,444 | 9/1969 | Bixby . | |
| 3,530,369 | 9/1970 | Thompson . | |
| 3,979,661 | 9/1976 | Matz . | |
| 4,622,629 | 11/1986 | Glennon . | |

*Primary Examiner*—Patrick R. Salce
*Assistant Examiner*—Emanuel Todd Voeltz
*Attorney, Agent, or Firm*—Albert S. Richardson, Jr.

[57] ABSTRACT

To increase the output voltage of a conventional rectifier bridge, one winding of an autotransformer is connected across a pair of a-c input terminals of the bridge through a thyristor which is turned on only when an output voltage increase is desired, and an extra diode is used to connect the other autotransformer winding to one of the d-c output terminals so that the boost voltage induced in the latter winding is added to the input voltage.

14 Claims, 4 Drawing Sheets

COMMAND
CONTROL
LOAD I
LOAD II
LOAD III
LOAD IV

ELECTRIC POWER SUPPLY WITH CONTROLLABLE VOLTAGE BOOST

BACKGROUND OF THE INVENTION

This invention relates to electric power supply apparatus of the kind that converts an alternating input voltage into a unipolarity output voltage, and it relates more particularly to such apparatus wherein the average magnitude of the output voltage is maintained equal to or higher than a predetermined minimum level regardless of variations in the amplitude of the input voltage and/or in the direct current load that is supplied by the apparatus.

There are many practical applications for a voltage reducing power transformer having a primary winding connected to an alternating current (a–c) electric power line or main of relatively high voltage and constant frequency (e.g., 60 Hertz) and having multiple secondary windings that are respectively connected to several different electrical load circuits of lower voltage. Where a load circuit requires direct current (d–c), a rectifying type of power supply apparatus needs to be provided between such a load and the associated secondary winding of the transformer. Such apparatus typically comprises a plurality of unidirectional electrical valves arranged in a full-wave bridge configuration having a pair of a–c input terminals connected to the associated transformer secondary winding and a pair of d–c output terminals connected to the load circuit.

The average magnitude of the unipolarity output voltage of such power supply apparatus depends on the amplitude and waveform of the input voltage. The input amplitude is subject to variations for various reasons. The amplitude of the line voltage applied to the primary winding of the power transformer may vary over a relatively wide range. Even if the line voltage were constant, the amplitude of the alternating voltage across the associated secondary winding will vary due to transformer regulation when there are variations in the load current that is flowing either in that winding or in another secondary winding of the same transformer. In order to minimize its size and cost for a given power rating, a transformer is conventionally designed to have relatively high reactance; consequently, the voltage drop in the internal impedance of the transformer changes appreciably as the magnitude of load current increases or decreases. There is another factor that will affect the average magnitude of output voltage in those applications where another secondary winding of the transformer is connected to a load circuit that includes a phase-controlled rectifier bridge. This factor is notches in the input voltage waveform during the recurrent intervals when the other winding is short circuited by the commutation action of the phase-controlled rectifier bridge.

Where the average magnitude of voltage applied to a d–c load circuit must be prevented from falling below a predetermined minimum, the power supply apparatus needs to include suitable means for increasing the output voltage during low input voltage conditions. This can be done in a variety of different ways. One way is to build the power transformer with less reactance, but this solution would increase the transformer size and cost. Another way involves increasing the voltage rating of the transformer secondary winding, using controllable valves (e.g., thyristors or silicon controlled rectifiers) for the unidirectional valves in the full-wave rectifier bridge of the power supply apparatus, and providing control means for "phase controlling" the bridge so that only part of the rectified input voltage waveform is normally applied to the load circuit when its amplitude is high but all is applied during abnormally low input voltage conditions. The disadvantages of this solution are the added costs of the thyristors and their controls, and the larger size and higher cost of the additional filter capacitors that would be required to attenuate the higher ripple content of the rectified input voltage under normal conditions.

A more practical way to increase the output voltage is to add a voltage step-up autotransformer and two pairs of suitably controlled inverse-parallel thyristors, as is disclosed, for example, in U.S. Pat. No. 3,263,157. In such prior art voltage regulators the autotransformer typically withstands the input voltage continuously, and therefore its power and thermal ratings would be relatively high and its size, weight and cost would be undesirably large. In addition, an undesirable amount of power would be dissipated and wasted as heat.

SUMMARY OF THE INVENTION

A general objective of the present invention is to provide electric power supply apparatus that utilizes an autotransformer in an improved way to obtain a controllable voltage boost.

Another objective is the provision, in electric power supply means for converting alternating input voltage to unipolarity output voltage, of an output voltage boosting autotransformer that is relatively small and inexpensive and that is connected to and controlled by only one pair of thyristors and two extra diodes.

Yet another objective of the invention is to provide improved power supply means in which the output voltage can be controllably boosted by an autotransformer of relatively small size, weight and cost without requiring any changes in either the source of power connected to the input terminals of the power supply means or the load circuit connected to the output terminals.

In carrying out the invention in one form, electric power supply means is formed by a plurality of unidirectional electrical valves (e.g., solid-state power diodes) that are interconnected and arranged in a full-wave rectifier bridge having first and second a-c input terminals and a pair of relatively positive and negative output terminals. The power supply means includes autotransformer means having first and second magnetically coupled windings connected between opposite end terminals. The first winding of the autotransformer means has more turns than the second winding. The first winding is connected between the input terminals of the rectifier bridge, with the junction of the two windings being connected to the first input terminal.

A controllable electrical valve (e.g., an inverse-parallel pair of solid-state power thyristors) is connected in series with the first winding of the autotransformer means between the input terminals. This valve has a normal non-conducting state in which the first winding is de-energized, and it is arranged, when activated to a conducting state, to enable the first winding to be energized by current from an a-c electric power source that is coupled to the input terminals of the rectifier bridge. When the first winding is thus energized, a boost voltage will be induced across the second winding of the autotransformer means. The instantaneous magnitude of the boost voltage is a predetermined fraction of the instantaneous magnitude of the input voltage.

The end terminal of the second winding is connected alternatively to the positive and negative output terminals of the rectifier bridge by means of first and second extra unidirectional electrical valves (e.g., solid-state power diodes). The first extra valve is arranged to conduct current if the first autotransformer winding is energized during alternate half cycles of the input voltage when the potential of the first input terminal is positive with respect to the potential of the second input terminal. This current flows from the first input terminal via the second autotransformer winding and the positive output terminal to a d-c electric load circuit that is coupled to the pair of output terminals. The second extra valve is arranged to conduct load current if the first autotransformer winding is energized during intermediate half cycles of the input voltage when the first input terminal is negative with respect to the second input terminal, and this current flows from the negative output terminal via the second autotransformer winding to the first input terminal. Consequently, the magnitude of output voltage applied to the load circuit while the autotransformer means is energized will equal the sum of the boost voltage and the voltage magnitude between the input terminals of the rectifier bridge.

The power supply means further comprises control means for initiating the conducting state of the controllable valve when a load voltage increase is desired. Preferably the control means is suitably arranged to advance or retard the moment of time at which the autotransformer means becomes energized during each half cycle of input voltage as necessary to prevent the average magnitude of the load voltage from decreasing appreciably below a desired minimum. So long as the average magnitude of load voltage exceeds the desired minimum, the control means is ineffective to activate the controllable valve, and consequently the autotransformer remains de-energized continuously. But when boost voltage is required to keep the average magnitude of load voltage from becoming less than the desired minimum, the autotransformer means will be energized for only a portion of each half cycle so that the volts-seconds that the second winding adds to the input voltage are just enough to increase the average magnitude of the load voltage to the desired minimum level.

The invention will be better understood and its various objectives and advantages will be more fully appreciated from the following description taken in conjunction with the accompanying drawings.

DETAILED DESCRIPTION

Figure 1:
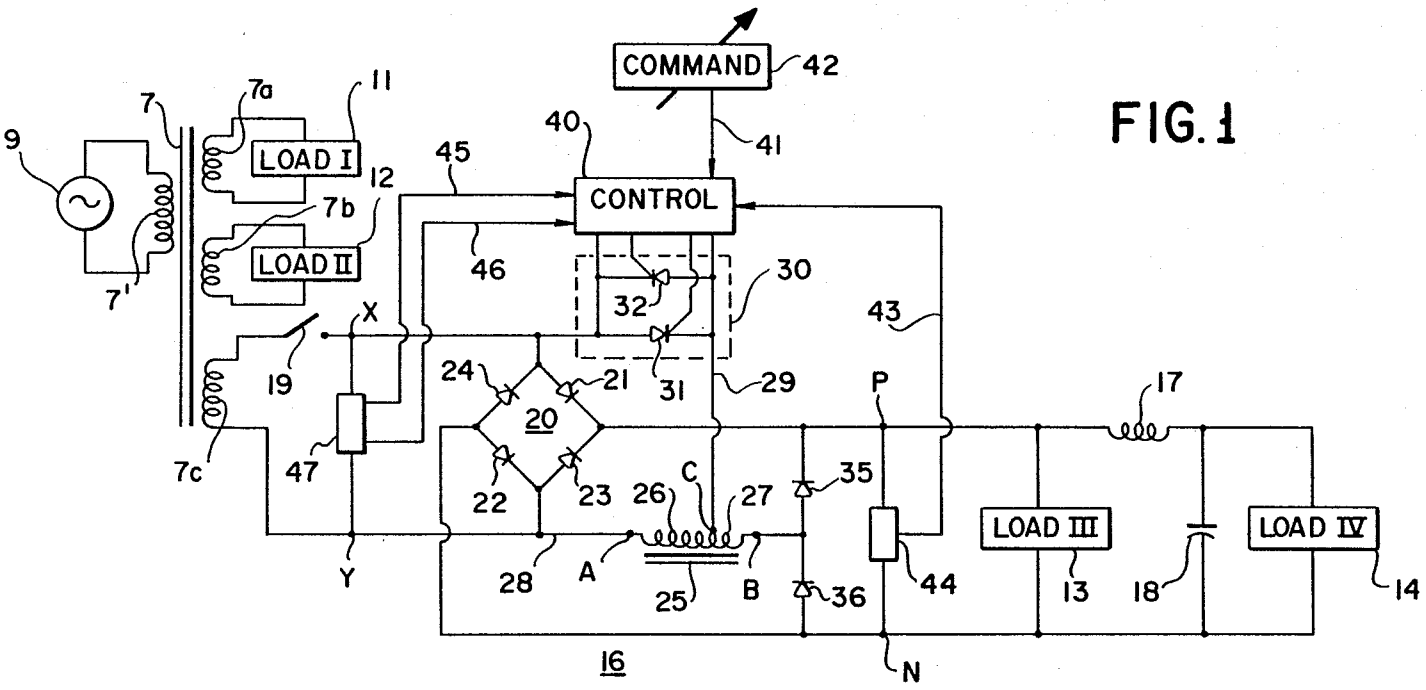
FIG. 1 is a schematic circuit diagram of an electric power system comprising a power transformer that has a single high-voltage primary winding and multiple secondary windings, a plurality of electrical load circuits that are respectively connected to the secondary windings, and the improved power supply means connected between one of the load circuits and its associated secondary winding.

Referring now to FIG. 1, the single-phase primary winding 7' of an electric power transformer 7 is connected to a suitable source 9 of alternating current (a–c) electric power. The source voltage typically alternates in polarity at a relatively constant frequency (e.g., 60 Hz), and its amplitude may be either relatively constant or variable over at least a predetermined range.

As is shown in FIG. 1, the transformer 7 has a plurality of single-phase secondary windings *7a*, *7b* and *7c* that are in turn connected to electric load circuits 11, 12, 13 and 14. The first transformer secondary winding *7a* is connected to the first load circuit 11, and the next secondary winding *7b* is separately connected to the second load circuit 12. The third winding *7c* of the illustrated secondary windings is connected via power supply means 16 to both of the third and fourth load circuits 13 and 14. These two loads are of a kind requiring direct current (d–c) from the power supply 16, and their ohmic impedance values will vary from time to time. A conventional electrical filter, comprising a series inductor 17 and a parallel capacitor 18, is used between the two load circuits 13 and 14 to attenuate the ripple content of d–c power supplied to the latter circuit. Suitable disconnecting means 19 is used between the secondary winding *7c* and the power supply means 16 for isolating or de-energizing the load circuits 13 and 14 when desired. The amplitude of voltage available at the winding *7c* is dependent on the voltage amplitude at the source 9 and the turns ratio of the transformer 7, and it tends to decrease as the transformer load current increases (due to the resulting increase in voltage drop across the internal transformer impedance).

The power supply 16 has a set of first and second input terminals X and Y connected to the a–c source 7 via the disconnecting means 19 and the magnetically coupled windings *7c* and 7' of the power transformer 7, and it has a set of relatively positive and negative output terminals P and N connected to the parallel load circuits 13 and 14. A full-wave rectifier 20 interconnects these input and output terminal sets. The rectifier 20 comprises at least four unidirectional electric valves 21, 22, 23 and 24 arranged in a bridge configuration having four branches or legs. During alternate half cycles of the source voltage, when the potential of the input terminal X is positive with respect to the potential of the input terminal Y, load current is freely conducted by the valve 21 in the first leg of the rectifier bridge, which leg connects terminal X to output terminal P, and by the valve 22 in the second leg which connects terminal N to the second input terminal Y, whereas the other two valves 23 and 24 are reversely biased and therefore block load current. During intermediate half cycles, when X is negative with respect to Y, load current is freely conducted by the valve 23 in the third leg of the rectifier bridge, which leg connects terminal Y to the output terminal P, and by the valve 24 in the fourth leg which connects the terminal N to the first input terminal X, whereas the first and second valves 21 and 22 are now reversely biased and therefore block load current. As a result, in operation the power supply means 16 will apply unipolarity voltage to the load circuits 13 The valves 21–24 are solid-state devices and can be either and 14. controlled or uncontrolled. Preferably, as shown, they are simple uncontrolled devices known generally as diodes, whereby the average magnitude of the load voltage between the output terminals P and N of the power supply 16 varies with the amplitude of the alternating voltage between the input terminals X and Y. Depending on the voltage and current ratings of the individual devices and of the power supply 16, each valve in the rectifier bridge 20 may actually comprise two or more solid-state devices in series and/or in parallel with one another.

In order to prevent the average magnitude of output voltage from decreasing below a predetermined level, if the amplitude of the input voltage between terminals X and Y is relatively low and/or when the magnitude of load current is relatively high, the power supply 16 includes an autotransformer 25 comprising first and second magnetically coupled, multi-turn coils or windings 26 and 27, respectively. These windings have a predetermined turns ratio. The turns ratio is selected to give the desired amount of voltage boost under low input voltage and/or high load current conditions, and in the embodiment of the invention illustrated in FIGS. 1–3 a ratio of approximately 2-to-1 is assumed (i.e., the first winding 26 has approximately twice as many turns as the second winding 27). The autotransformer 25 has separate terminals A and B at opposite ends of its two windings 26 and 27, and it has a common terminal C at their junction.

In accordance with the present invention, the first winding 26 of the autotransformer 25 is connected between the alternating voltage input terminals X and Y of the power supply means 16 by means of a first line 28 that connects the end terminal A to the terminal Y and a second line 29 that connects the common terminal C to the other input terminal X. In addition, a controllable, bi-directional electric valve 30 is provided in series with either one of the lines 28 and 29 and consequently in series with the first winding 26. Preferably the latter valve comprises a pair of controllable, unidirectional valves or thyristors 31 and 32 that are interconnected in inversely-poled parallel relationship, and it is inserted between the line 29 and the first input terminal X as shown in FIG. 1. Each of the illustrated thyristors 31 and 32 may actually comprise two or more solid-state switching devices or silicon controlled rectifiers (SCRs) connected in series and/or in parallel with one another and arranged to turn on in unison.

The bi-directional valve 30 has a normal non-conducting or inactive state in which the ohmic value of its internal resistance is extremely high, thereby blocking current in either direction. While in this state the valve 30 absorbs the full magnitude of the input voltage. Consequently the winding 26 is effectively de-energized and there is no voltage across the second winding 27 of the autotransformer 25. Alternatively, the valve 30 has a conducting or active state in which its internal resistance is very low and current is now able to flow freely from the input terminals X and Y through the first winding 26. When the latter winding is thus energized, a boost voltage will be induced across the second autotransformer winding 27. The instantaneous magnitude of the boost voltage will be approximately one-half the instantaneous magnitude of the input voltage (assuming a 2-to-1 turns ratio), and the potential at the end terminal B of winding 27 will have the same polarity with respect to terminal C as the potential at the common terminal C has with respect to the opposite end terminal A of the winding 26.

The boost voltage is rectified and added to the rectified input voltage by using an extra pair of unidirectional electric valves 35 and 36 to connect the end terminal B alternatively to the positive and negative output terminals P and N. Preferably the valves 35 and 36 are solid state diodes. As is shown in FIG. 1, the first extra valve 35 is located and arranged to conduct load current from the input terminal X via the bidirectional valve 30 and the second winding 27 of the autotransformer to the relatively positive output terminal P during the aforesaid alternate half cycles of input voltage (when X is positive with respect to Y), whereas the other extra valve 36 is located and arranged to conduct load current from the negative output terminal N via the second winding 27 and the valve 30 to the same input terminal X during the aforesaid intermediate half cycles of input voltage (when X is negative with respect to Y). Consequently, whenever the valve 30 is conducting current so as to energize the first autotransformer winding 26, the magnitude of direct voltage that the power supply 16 applies to the load circuit 13 equals the sum of the boost voltage and the magnitude of the input voltage between the terminals X and Y. For a 2-to-1 autotransformer turns ratio, the sum is 150% of the input voltage magnitude. It will be apparent that so long as the extra valve 35 is conducting load current the relatively positive potential at the output terminal P is 50% higher than the potential at the input terminal X, whereby a reverse voltage is impressed across the valve 21 in the rectifier bridge 20 (i.e., the anode potential of this valve is now negative with respect to the cathode) and this valve is not conducting. It will also be apparent that so long as the extra valve 36 is conducting load current the negative potential at the output terminal N is 50% lower than the potential at the input terminal X, whereby a reverse voltage is impressed across the valve 24 in the rectifier bridge 20 and this valve is not conducting.

In the presently preferred embodiment, the bi-directional valve 30 comprises an inverse-parallel pair of thyristors as previously explained. A thyristor is typically a 3-electrode device having an anode, a cathode, and a control or gate terminal. When its anode and cathode are externally connected in series with an electric power load and a source of forward anode voltage (i.e., anode potential is positive with respect to cathode), a thyristor will ordinarily block appreciable load current until a firing or trigger signal is applied to its gate, whereupon it switches from its blocking or "off" state to a conducting or "on" state. Subsequently, due to the periodic reversal of the input voltage polarity, the anode will become reverse biased whereupon the thyristor automatically turns off (i.e., it reverts to a blocking or non-conducting state) by an "a–c line commutation" process. The time at which the thyristor is turned on, measured in electrical degrees from a cyclically recurring instant at which its anode voltage becomes positive with respect to its cathode at the start of the appropriate half cycle of the alternating input voltage, is known as the "firing angle." The average magnitude of the rectified boost voltage can be varied by retarding or advancing the firing angle as desired. This is popularly known as "phase control."

The power supply means 16 includes control means 40 for providing properly timed firing signals for the gates of the respective thyristors 31 and 32 that form the bidirectional valve 30. The control means 40 receives a first input signal on a line 41 from associated command means 42 that sets the value of the first signal at a predetermined level corresponding to a desired minimum average magnitude of the output voltage of the power supply means 16. The control means 40 also receives a feedback signal on a line 43 from suitable unipolarity voltage sensing means 44 spanning the output terminals P and N, whereby the value of this feedback signal is representative of the magnitude of the actual output voltage. For synchronizing the firing signals with the zero crossings of the source voltage, the control means is coupled via a pair of additional input lines 45 and 46 to suitable alternating voltage sensing means 47 spanning the input terminals X and Y of the power supply means.

So long as the amplitude of the input voltage is sufficiently high, the actual average magnitude of the output voltage will exceed the desired minimum average magnitude of this voltage, as selected by the command means 42. In this event no thyristor firing signals would be provided by the control means 40, the bidirectional valve 30 would remain continuously in its normal non-conducting state, and no boost voltage would be added to the input voltage. But whenever the input voltage amplitude is insufficient alone to sustain the desired minimum output voltage, the average magnitude of the output voltage tends to fall below this minimum level and the control means 40 responds by providing a family of first and second periodic firing signals that cause the valve 30 to change to its conducting state. More particularly, the firing signals are effective alternately to turn on the thyristors 31 and 32 during successive half cycles of the input voltage, whereupon the first winding 26 of the autotransformer 25 is energized, boost voltage is now developed across the second winding 27, and the rectified half cycles of this boost voltage are added to the rectified half cycles of the input voltage so as to increase the average magnitude of the load voltage as previously described.

The control means 40 is suitably arranged to vary the firing angle of the periodic firing signals as necessary to reduce to zero the difference between the actual average magnitude of the load voltage and the desired minimum thereof. As the input voltage amplitude decreases, the firing angle is advanced from full retard (approximately 180 degrees) toward full advance (approaching 0 degrees), thereby increasing the average magnitude of the rectified boost voltage from zero to a maximum. If commutation notches in the waveform of the input voltage were ignored, the maximum average magnitude of boost voltage would be nearly one-third the amplitude of the alternating input voltage. In one practical embodiment of the invention, the average magnitude of output voltage is permitted to vary in a normal range between a maximum level of approximately 750 volts and a minimum level of approximately 540 volts, and the control means 40 is effective to regulate the boost voltage so as to maintain this minimum level if the input voltage amplitude falls below its lowest permissible level with zero boost voltage but not below two-thirds of such level.

Figure 2:
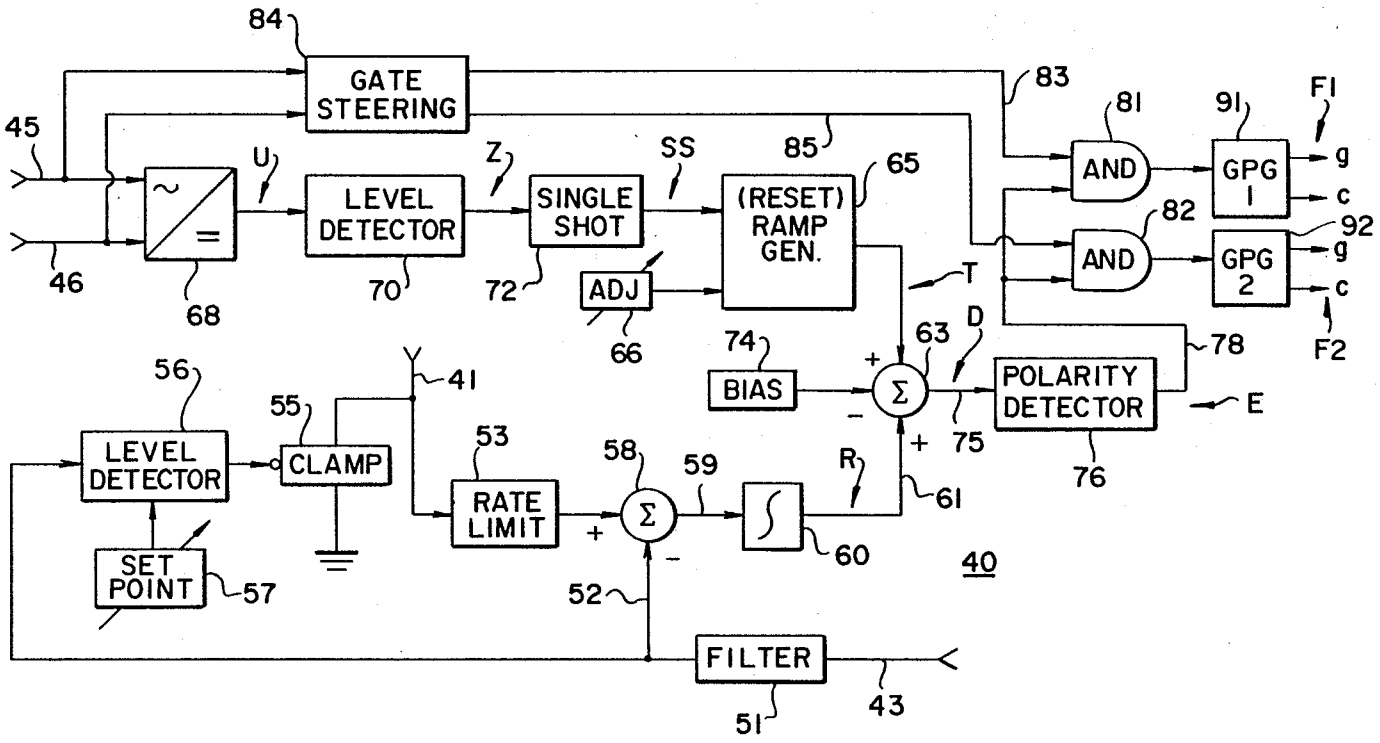
FIG. 2 is a simplified schematic block diagram of the presently preferred embodiment of the power supply control means shown as a single block in FIG. 1.
Figure 3:
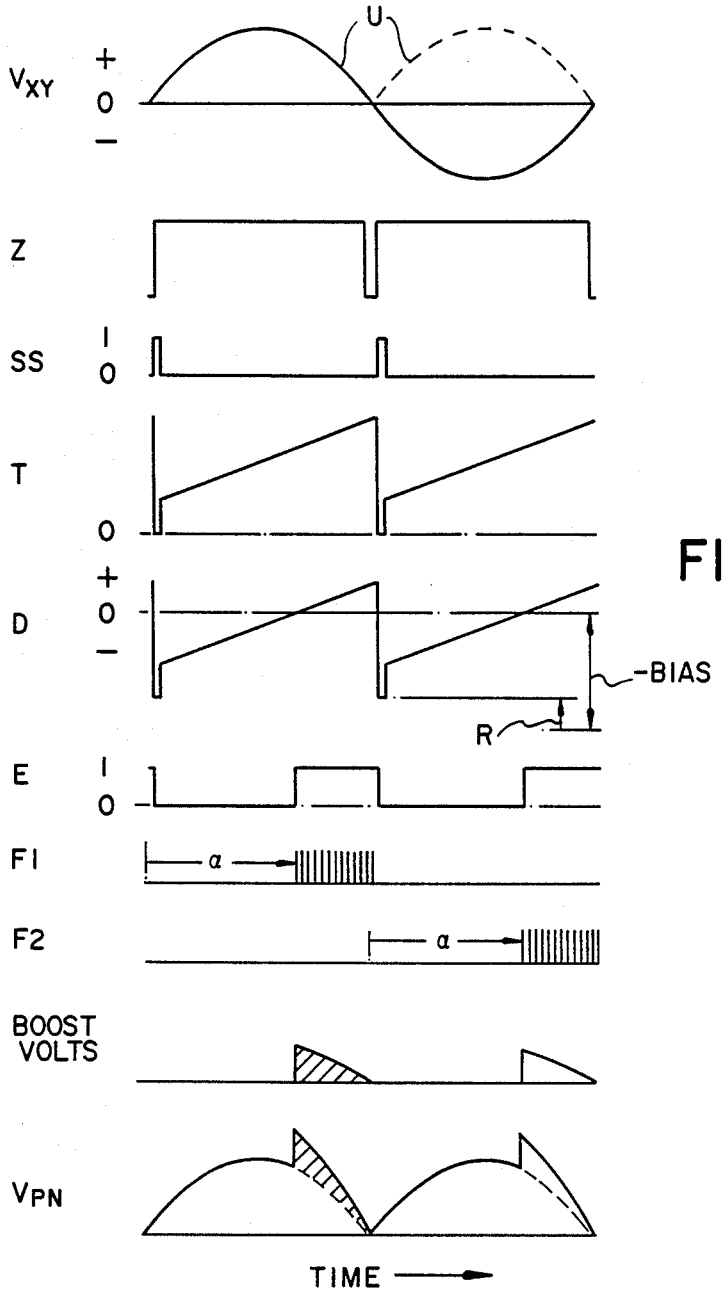
FIG. 3 is a time chart showing the waveforms of the input and output voltages of the FIG. 1 power supply means as well as various identified values in the FIG. 2 control means over one whole cycle of the input voltage.

Persons skilled in the art will understand that the functions of the control means 40 can be implemented in a variety of different ways, including by software for programming a microcomputer. The presently preferred way is illustrated in FIGS. 2 and 3 which will now be briefly described. The line 43 supplies the feedback signal of undulating magnitude from the voltage sensor 44 (FIG. 1) to a conventional electrical filter 51 having an output line 52. The filter 51 smooths or averages the feedback signal, whereby the value on its output line 52 is representative of the average magnitude of the unipolarity load voltage between the output terminals P and N of the power supply 16. The line 41 supplies the first signal from the command means 42 (FIG. 1) to a conventional rate limit circuit 53 having an output line 54. The value on the latter line corresponds to the desired minimum average magnitude of the load voltage; it will track the value set by the command means, but a relatively gentle gradient is introduced by the rate limit circuit 53 in response to a more abrupt change of the value on the line 41. Preferably, as is shown in FIG. 2, the control means includes suitable means 55 for clamping the value on the line 41 to zero so long as the value on the line 52 is less than a certain level at which a level detector 56 becomes effective. If the average magnitude of load voltage were lower than a predetermined amount (e.g., 190 volts), as determined by a set point adjuster 57 associated with the level detector 56, the clamping means 55 would be operative to hold the value on the line 41 equal to zero; otherwise the level detector 56 is effective to disable or defeat the clamping means 55, thereby allowing the value on the line 41 to have whatever level is set by the command means 42.

The values on the lines 52 and 54 are differentially fed to a summing point 58 where the value representative of the average magnitude of the actual load voltage is subtracted from the rate-limited value corresponding to the desired minimum average magnitude. The resulting difference or error value is supplied via a line 59 to the input of conventional means 60 for integrating the error value. The output of the integrator 60 is a reference value "R" that will vary at a rate that depends on the error value, changing in a positive-going sense during intervals when the error value on the line 59 is relatively positive, changing in a negative-going sense during intervals when the error value is negative, and remaining constant so long as the error value is zero. The reference value R is supplied via an output line 61 of the integrator 60 to another summing junction 63 where it is added to an output value of a conventional linear ramp generator 65.

The ramp generator 65 is suitably arranged to produce a triangular waveform output "T" that increases in a positive-going sense at a predetermined constant rate. The ramp generator is automatically recycled or cleared every half cycle of the alternating voltage between the input terminals X and Y of the power supply means 16, and each time it is recycled the ramp generator resets its triangular waveform output to an initial or quiescent value that is determined by an adjuster 66 associated therewith. The recycling will occur in synchronism with successive zero crossings of the input voltage.

As is shown in FIG. 2, the lines 45 and 46 from the alternating voltage sensor 47 (FIG. 1) are connected in the control means 40 to rectifying means 68 for supplying to the input of a level detector 70 a unipolarity replica "U" of the input voltage. The level detector 70 has alternative first and second states. So long as the instantaneous magnitude of the replica voltage U does not exceed a predetermined relatively low threshold, the level detector 70 is in its first state in which its output value X is low or negative. Otherwise the level detector is in its second state in which Z is high or positive. In effect, the output value Z of the level detector 70 is a square waveform version of the unipolarity replica voltage U. This value is supplied as an input signal to a conventional monostable "single shot" function 72 which has a binary output signal "SS." The output signal SS is normally low or "0" but it will switch to a high or "1" state for a relatively short interval of predetermined constant duration (e.g., approximately 200 microseconds) in response to each positive-going transition of the input signal Z. Since successive high intervals of the signal SS commence at the start of successive half cycles of the square waveform Z, they are synchronized with the zero crossings of the alternating input voltage.

The output signal SS of the single shot function 72 is applied to the reset terminal of the linear ramp generator 65. During each of the high intervals of SS, the ramp generator 65 is reset and the triangular waveform T at its output will be zero. At the end of each such interval, the waveform T steps up to its predetermined initial value and then proceeds to increase further at the aforesaid constant rate until the start of the next reset interval.

In the summing junction 63 the reference value R on the output line 61 of the integrator 60 and the triangular waveform T from the ramp generator 65 are added together, and a predetermined fixed bias value is subtracted from their sum. The bias value is supplied by a source 74, and it is selected to be slightly larger than the maximum excursion of the waveform T between successive reset intervals. Consequently the algebraic sum "D"of the reference value, the triangular waveform, and the bias value will always be negative so long as the reference value is not positive. The latter sum is supplied via an polarity. The polarity detector 76 has alternative first and second states. So long as the input value D is zero or relatively negative, the polarity detector is in its first state in which its binary output signal "E" is low or "0", but if and when D becomes positive the polarity detector switches to its second state in which E is high or "1". It will now be apparent that the exact moment during each half cycle of input voltage at which the 0to-1 transition of the polarity detector's output signal E occurs will be determined by the reference value R. When R is positive, the higher its value the earlier this transition occurs.

As can be seen in FIG. 2, the output signal via a line 78 to a first one of the inputs of each of two AND logic functions 81 and 82. The other input to the first logic function 81 is a binary signal received over a line 83 from a gate steering circuit 84 which is coupled to the lines 45 and 46. The other input to the second logic function 82 is a binary signal received over a line 85 from the same gate steering circuit. During the alternate half cycles of the input voltage when the potential at terminal X is positive with respect to terminal Y, the signal on the line 83 is "1" and the signal on the line 85 is "0", whereas during the intermediate half cycles of input voltage when the terminal X is negative with respect to the terminal Y, the signal on the line 83 is "0" and the signal on the line 85 is "1". Consequently the output signal from the first logic function 81 will change from 0 to 1 concurrently with this change of the signal E on the line 78 during the alternate half cycles of input voltage, whereas the output signal from the second logic function 82 will change from 0 to 1 concurrently with this change of the signal E during the intermediate half cycles of input voltage.

The output signal of the first logic function 81 is supplied to a first gate pulse generator 91 that produces a firing signal F1 for the gate of the first thyristor 31 in the bidirectional valve 30 (FIG. 1), and the output signal of the second logic function 82 is supplied to a second gate pulse generator 92 that produces a firing signal F2 for the gate of the second thyristor 32 in the same valve. In either case the firing signal is produced only during the periodic intervals when the gate pulse generator is enabled by a "1" signal from the associated logic function. Preferably each gate pulse generator includes an oscillator and is constructed and arranged so that its firing signal actually comprises a train of high-frequency discrete electrical pulses. For example, each pulse in this train has a relatively short, constant width of approximately 14 microseconds, and the pulses recur at a frequency of approximately 12 KHz.

The manner in which the control means 40 controls the operation of the power supply means 16 will be better understood by considering a particular example that is illustrated in FIG. 3 for one full cycle of the alternating input voltage. In FIG. 3 the first solid-line trace $V_{XY}$ represents the alternating voltage between the input terminals X and Y, and the trace U is the unipolarity replica thereof at the output of the rectifying means 68. (For the purpose of drawing simplification, the input voltage has been given a generally sinusoidal waveform, and distortions caused by commutation notches and the like have been neglected.) The second trace is the square waveform output value Z of the level detector 70, and the third trace is the resulting output signal SS of the single shot function 72. The trace T depicts the triangular waveform generated by the linear ramp generator 65 as explained above.

The next trace in FIG. 3 shows the value D on the output line 75 of the summing junction 63 for an assumed positive value of the reference signal R on the integrator output line 61. Note that the base line of D (i.e., its most negative value) coincides with T=0, and it equals the assumed value of R minus the fixed bias value from the source 74. The output signal E of the polarity detector 76 is 1 only while D is positive. The resulting firing signal for the first thyristor 31 is shown at FI, and the resulting firing signal for the companion thyristor 32 is shown at F2. The firing angle at which these firing signals commence is designated in FIG. 3 by the letter alpha.

Once the firing signal FI has initiated the conducting state of the first thyristor 31 during a positive half cycle of the input voltage, the first winding 26 of the autotransformer 25 is energized by current flowing through this thyristor in a forward direction from the input terminals, and for the remainder of that half cycle the rectified boost voltage across the second autotransformer winding 27 is added to the rectified input voltage so that the load voltage $V_{PN}$ between the output terminals P and N of the power supply means 16 equals 150% of the input voltage. In FIG. 3 the shaded area of $V_{PN}$ is the volt-seconds of boost voltage that are added to the input voltage during its positive half cycle. Similarly, once the second firing signal F2 has initiated the conducting state of the oppositely-poled thyristor 32 during a negative half cycle of the input voltage, the first autotransformer winding 26 is again energized by current flowing through the thyristor 32 from the input terminals, and for the remainder of that half cycle $V_{PN}$ equals 150% of the input voltage. It will be observed that the average magnitude of $V_{PN}$ will vary inversely with the firing angle. In other words, as the firing angle is decreased (i.e., advanced) more volt-seconds of boost voltage are added to the rectified input voltage.

Under steady state conditions, the assumed positive value of the reference value R at the output of the integrator 60 is obtained when the error value at the output of the summing point 58 is zero. This is true so long as the average magnitude of the actual load voltage equals the desired minimum average magnitude thereof. However, when the average magnitude deviates from the desired minimum, a finite error value develops, and the integrator 60 responds by increasing or reducing R, depending on whether the average magnitude is smaller or larger than desired, at a rate proportional to the size of the error. If the average magnitude were smaller than desired, R would increase to raise the baseline of the value D at the output of the summing junction 63, thereby advancing (decreasing) the firing angle alpha and increasing the volt-seconds of boost voltage that are added to the input voltage each half cycle until the error value is again reduced to zero. Alternatively, if the average magnitude were larger than the desired minimum, R would decrease to lower the baseline of D, thereby retarding (increasing) alpha and reducing the added boost volt-seconds until the error value is once again reduced to zero. Note that after the reference value R is reduced to zero or to a negative value, the value D will remain negative throughout the cycle and, consequently, the thyristor firing signals F1 and F2 are suppressed.

Since the autotransformer 25 is never energized when the average magnitude of the actual load voltage exceeds the desired minimum average magnitude under steady state conditions, and since it is energized only intermittently when its volt-seconds are required to increase the load voltage as is illustrated in FIG. 3, the power rating of the autotransformer 25 can be a fraction of that of the power supply means 16. In other words, the volt-ampere rating and thermal capability of the autotransformer are significantly lower than would be true if the autotransformer were energized continuously. Consequently the size, weight and cost of the autotransformer 25 are comparatively small. Similarly, the controllable valve 30 and the extra pair of unidirectional valves 35 and 36 will conduct current for only a portion of each half cycle of source voltage when the boost voltage is required, and consequently the current ratings, size and cost of these power devices (as well as the size and cost of their respective heat sinks) are significantly smaller than would be the case if the autotransformer were energized continuously.

Figure 4:
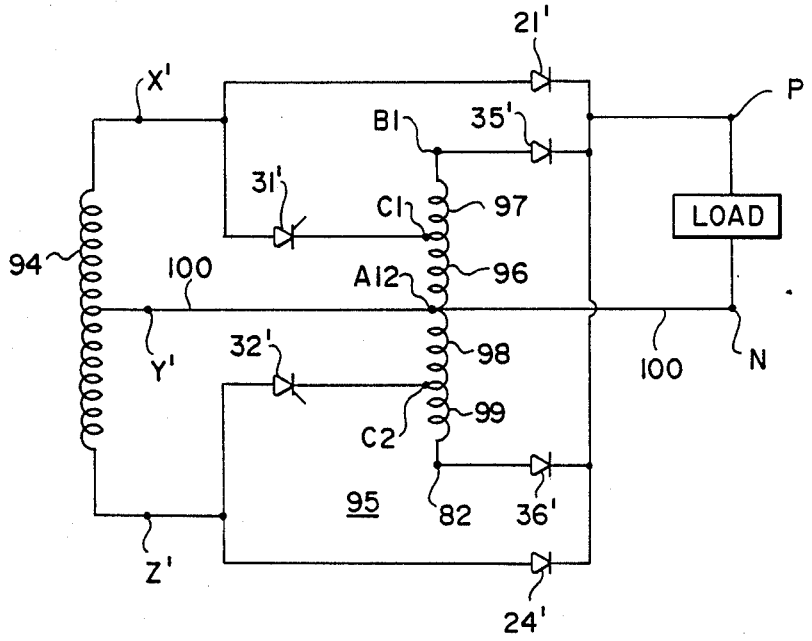
FIG. 4 is a schematic circuit diagram of another embodiment of the improved power supply means.

FIG. 4 illustrates an alternative embodiment of the invention wherein the power supply means has a set of three input terminals X', Y', and Z'. The first and third terminals X' and Z' are respectively connected to opposite ends of a center-tapped, single-phase secondary winding 94 of an electric power transformer, and the second input terminal Y' is connected to the center tap of this winding. In this embodiment, the first input terminal X' is connected to the positive output terminal P of the power supply means by way of a unidirectional electric valve or diode 21' which is arranged to conduct load current during the aforesaid alternate half cycles of source voltage (when X' is positive with respect to Y') and to block load current during the intermediate half cycles (when X' is negative with respect to Y'). The third input terminal Z' of this power supply means is also connected to the positive output terminal P via another unidirectional value or diode 24' arranged to conduct load current during the intermediate half cycles of source voltage and to block load current during the alternate half cycles, and the second input terminal Y' is connected directly to the relatively negative output terminal N via a line 100.

The power supply means shown in FIG. 4 includes autotransformer means 95 comprising first and second magnetically coupled, multi-turn windings 96 and 97 and third and fourth magnetically coupled, multi-turn windings 98 and 99 having the same turns ratio as the windings 96 and 97. Adjoining ends of the first and third autotransformer windings 96 and 98 share the same terminal A12 which is connected to the line 100. A common terminal C1 between the first and second windings 96 and 97 is connected to the first input terminal X' by means of a first controllable electric valve or thyristor 31' which is arranged, when activated to its conducting state, to enable the first winding 96 to be energized from the upper half of the transformer secondary winding 94 during alternate half cycles of the input voltage, and an end terminal B1 of the second winding 97 is connected to the positive output terminal P by means of a first extra unidirectional valve or diode 35' which conducts load current from the first input terminal X' via the voltage boosting winding 97 to the output terminal P if the first winding 96 is energized. A common terminal C2 at the junction of the other two windings 98 and 99 of the autotransformer means 95 is connected to the third input terminal Z' by means of a second controllable electric valve or thyristor 32' which is arranged, when activated to a conducting state, to enable the third winding 98 to be energized from the lower half of the winding 94 during intermediate half cycles of the input voltage, and an end terminal B2 of the fourth winding 99 is connected to the positive output terminal P by means of a second extra unidirectional valve or diode 36' which conducts load current from terminal Z' via the voltage boosting winding 99 to the output terminal P if the third winding 98 is energized.

It will be apparent that suitable control means (not shown in FIG. 4) is used to provide periodic firing signals, similar to the signals designated F1 and F2 in FIGS. 2 and 3, that are effective alternately to initiate the conducting states of the thyristors 31' and 32' during successive half cycles of source voltage when a load voltage increase is desired, in which event the magnitude of voltage at the output terminals P and N of the power supply means shown in FIG. 4 will equal the sum of the boost voltage induced in the second autotransformer winding 97' (or during intermediate half cycles of input voltage, in the fourth winding 99) and the voltage magnitude between the pair of input terminals X' and Y' (or pair Z' and Y'). In all other respects the operation and advantages of the FIG. 4 embodiment are essentially the same as described hereinabove.

While two specific embodiments of the invention have been shown and described by way of illustration, other modifications will undoubtedly occur to persons skilled in the art. For example, when there is a need for boost voltage from the second autotransformer winding 27 shown in FIG. 1, the controllable valve 30 could be operated as a simple switch, with its firing angle always fully advanced rather than being phase controlled. In this case the boost voltage could be either regulated or unregulated. In order to regulate the boost voltage if the valve 30 were not phase controlled, the extra valves 35 and 36 would need to be phase-controlled thryistors instead of the diodes that are shown. The concluding claims are therefore intended to cover all such modifications as fall within the true spirit and scope of the invention.

What is claimed:

1. Power supply means for applying voltage to a direct current electric load circuit, the supply means having a set of input terminals adapted to be connected to an electric power source characterized by a voltage of alternating polarity, a set of relatively positive and negative output terminals adapted to be connected to the load circuit, and means for interconnecting the input and output terminal sets, said interconnecting means including a unidirectional electric valve arranged to conduct load current during alternate half cycles of source voltage when the potential of a first terminal in said set of input terminals is positive with respect to the potential of a second input terminal and to block load current during intermediate half cycles when said first input terminal is negative with respect to said second input terminal, wherein the improvement comprises:

a. autotransformer means comprising first and second magnetically coupled, multi-turn windings having a predetermined turns ratio, said autotransformer means having separate terminals at opposite ends of said first and second windings, respectively, and a common terminal at the junction of said windings;

b. first means for connecting the first winding of said autotransformer means between said first and second input terminals, with said common terminal being connected to said first input terminal, said first means including a controllable electric valve in series with said first winding, said controllable valve having a normal non-conducting state in which said first winding is de-energized and being arranged, when activated to a conducting state, to enable said first winding to be energized so that a boost voltage will be induced between the common terminal and the end terminal of said second winding;

c. second means including a first extra unidirectional electric valve for connecting the end terminal of said second winding to said positive output terminal, said first extra valve being arranged to conduct load current from said first input terminal via said second winding to said positive output terminal during said alternate half cycles if said first winding is energized, whereby the magnitude of voltage applied to the load circuit equals the sum of said boost voltage and the voltage magnitude between said input terminals; and d. control means for causing said controllable valve to change from its normal non-conducting state to its conducting state when a load voltage increase is desired.

2. The power supply means as in claim 1, in which said control means provides periodic firing signals that are effective to initiate the conducting state of said controllable valve during said alternate half cycles of source voltage when a load voltage increase is desired.

3. The power supply means as in claim 2, in which said control means includes means for advancing or retarding, as desired, the firing angle at which said firing signals actually commence with respect to the zero crossings of said source voltage.

4. The power supply means as in claim 3, in which said improvement includes means for sensing the average magnitude of the voltage applied to the load circuit and means for selecting a desired minimum average magnitude of said load voltage, and in which said firing angle is varied as necessary to prevent the sensed average magnitude from decreasing appreciably below said desired minimum.

5. The power supply means as in claim 1, in which said first extra valve is a diode.

6. The power supply means as in claim 1, in which said source includes a center-tapped, single-phase secondary winding of an electric power transformer, said first input terminal is adapted to be connected to one end of said single-phase winding, said second input terminal is adapted to be connected to the center tap of said single-phase winding, a third terminal in said set of input terminals is adapted to be connected to the other end of said single-phase winding, said interconnecting means includes another unidirectional electric valve arranged to conduct load current during said intermediate half cycles of source voltage and to block load current during said alternate half cycles, said autotransformer means comprises third and fourth magnetically coupled, multi-turn windings having another common terminal at their junction, third means is provided for connecting said third winding between said second and third input terminals with said other common terminal being connected to said third input terminal, said third means includes a second controllable electric valve in series with said third winding and arranged, when activated from a normal non-conducting state to a conducting state, to enable said third winding to be energized so that a boost voltage will be induced between said other common terminal and an end terminal of said fourth winding, fourth means is provided for connecting the end terminal of said fourth winding to said positive output terminal, said fourth means includes a second extra unidirectional electric valve arranged to conduct load current from said third input terminal via said fourth winding to said positive output terminal during said intermediate half cycles if said third winding is energized, and in which said control means provides periodic firing signals that are effective alternately to initiate the conducting states of said controllable valves during successive half cycles of source voltage when a load voltage increase is desired.

7. The power supply as in claim 1, in which said interconnecting means includes a plurality of unidirectional electric valves arranged in a full-wave rectifier bridge configuration so that a first one of the valves can conduct load current during said alternate half cycles of source voltage whereas another one of the valves can conduct load current during said intermediate half cycles, in which said controllable valve is bi-directional, said second means includes first and second extra unidirectional valves for alternately connecting the end terminal of said second winding to said positive and negative output terminals, with said second extra valve being arranged to conduct load current from said negative output terminal via said second winding to said first input terminal during said intermediate half cycles if said first winding is energized, and said control means provides periodic firing signals that are effective to initiate the conducting state of said controllable, bi-directional valve during successive half cycles of source voltage when a load voltage increase is desired.

8. The power supply means as in claim 7, in which said controllable, bi-directional valve comprises at least two controllable, unidirectional electric valves connected in inversely-poled, parallel relationship with one another.

9. The power supply means as in claim 7, in which said interconnecting means includes at least four unidirectional electric valves which are diodes.

10. The power supply means as in claim 7, in which said controllable, bi-directional valve comprises first and second thyristors connected in inversely-poled, parallel relationship with one another.

11. The power supply means as in claim 10, in which said extra valves are diodes.

12. The power supply means as in claim 10, in which said control means provides a family of first and second periodic firing signals when a load voltage increase is desired, said firing signals being effective respectively to turn on said first thyristor during said alternate half cycles of source voltage and to turn on said second thyristor during said intermediate half cycles of source voltage.

13. The power supply means as in claim 10, in which said control means includes means for advancing or retarding, as desired, the firing angle at which said firing signals actually commence with respect to the zero crossings of said source voltage.

14. The power supply means as in claim 13, in which said improvement includes means for sensing the average magnitude of the voltage applied to the load circuit and means for selecting a desired minimum average magnitude of said load voltage, and in which said firing angle is varied as necessary to prevent the sensed average magnitude from decreasing appreciably below said desired minimum.

* * * * *